US006079635A

United States Patent [19]

Fuller et al.

[11] Patent Number: 6,079,635

[45] Date of Patent: Jun. 27, 2000

[54] WATER DISPLAY NOZZLE SHIELDS

[75] Inventors: Mark W. Fuller, North Hollywood; Chuck Schmitz, La Crescenta; James Doyle, Burbank; Ray Engelhardt, Canyon County; Mark Fitzsimmons, Reseda, all of Calif.

[73] Assignee: Wet Enterprises, Inc., Universal City, Calif.

[21] Appl. No.: 09/173,060

[22] Filed: Oct. 14, 1998

[51] Int. Cl.[7] ..... B05B 17/08

[52] U.S. Cl. ..... 239/17

[58] Field of Search ..... 239/16, 17, 18, 239/19, 20, 21, 22, 23, 391, 393, 288, 288.3, 388.5, 451, 456, 457, 459; 169/24

[56] References Cited

U.S. PATENT DOCUMENTS

| | | | |
|---|---|---|---|
| 979,771 | 12/1910 | Kunzelmann, Sr. | 239/393 |
| 2,345,813 | 4/1944 | Harimann | 239/391 |
| 2,823,076 | 2/1958 | Nurkiewicz | 239/393 |
| 3,722,816 | 3/1973 | Stewart et al. | 239/17 |
| 4,795,092 | 1/1989 | Fuller | 239/23 X |
| 5,480,094 | 1/1996 | Fuller et al. | 239/17 |

*Primary Examiner*—Kevin Weldon
*Assistant Examiner*—Sean P. O'Hanlon
*Attorney, Agent, or Firm*—Blakely, Sokoloff, Taylor & Zafman LLP

[57] ABSTRACT

Water display nozzle shields for allowing water display nozzles to be positioned and operated below the surface of the body of water without constant entrainment of water from the body of water affecting the nozzle characteristics. In one embodiment, a rotatable shield assembly is controllably rotatable between first and second positions. In the first position, the shield assembly is positioned over the nozzle of the water display and substantially sealed with respect thereto, the shield extending from adjacent the exit end of the nozzle which is positioned below the water level, to a position above the water level. When rotated to a second position, the nozzle shield, as well as the nozzle, are both disposed below the surface of the water so as to not be visible. In another embodiment, a weighted inflatable member is attached to the nozzle adjacent the exit thereof which, when inflated, will float to the surface of the water to provide a shield functioning as here before described and which, when deflated, will sink below the surface of the water out of sight. Various features of the shields are disclosed.

30 Claims, 8 Drawing Sheets

WATER DISPLAY NOZZLE SHIELDS

BACKGROUND OF THE INVENTION

1. Field of the Invention

The present invention relates to the field of water displays.

2. Prior Art

Water displays of increasing sophistication and complexity are being more frequently installed as decorative attractions around commercial buildings and complexes of various kinds. Many such water displays include a body of water in the form of a pool or small lake in which various individual water displays or features are placed. Such individual water displays normally are comprised of one or more nozzles of various types, oriented in a vertical direction and providing the desired characteristics for shaping the water display as the water is expelled from the nozzles, proceeds upwards and falls back to the body of water.

Certain prior art nozzles are intended to operate just below the surface of the water and, accordingly, are generally not visible to persons standing at the edge of the body of water when the same are not operating. The performance of other nozzles, however, depends on the exit end of the nozzle being above the surface of the body of water so as to not entrain water from the body of water or otherwise be affected by the presence of the body of water.

In the prior art, for those nozzles which needed to have the exit above the surface of the body of water in which they are disposed for proper operation thereof, various techniques have been used to accomplish this. The simplest, of course, is to merely support the nozzle in the body of water, typically from the bottom thereof, so that the nozzle is permanently disposed with at least the exit end of the nozzle above the surface of the water. This, of course, is normally by far the simplest and least expensive technique, though has the disadvantage that when the water display is not being used, the nozzle tip is still visible to persons standing or walking in the vicinity of the edge of the body of water. This is rather unsightly in comparison to an unobstructed water surface, and further eliminates the element of surprise when an otherwise apparently clear unobstructed body of water suddenly comes to life with an animated, frequently lighted, water display.

Another technique which has been used is to mount the nozzle on some structure which includes an elevating capability to elevate the exit end of the nozzle to above water level whenever the same is to be used, and to otherwise pull the nozzle entirely below the water level when the same is not being used. This technique can work well in certain situations, though has its limitations. For instance, if a large number of nozzles is displaced over a large area, a single structure for supporting all nozzles would not be practical, and in fact not achieve the desired result, as nozzles could not be raised individually or in subgroups as the same were to be used. Elevating mechanisms for each individual nozzle, however, may not be cost effective, particularly when a large number of relatively small nozzles are being used, as the complexity of the elevating system can dwarf the simplicity of the nozzle system used in such applications.

BRIEF SUMMARY OF THE INVENTION

Water display nozzle shields for allowing water display nozzles to be positioned and operated below the surface of the body of water without constant entrainment of water from the body of water affecting the nozzle characteristics are disclosed. In one embodiment, a rotatable shield assembly is controllably rotatable between first and second positions. In the first position, the shield assembly is positioned over the nozzle of the water display and substantially sealed with respect thereto, the shield extending from adjacent the exit end of the nozzle, which is positioned below the water level, to a position above the water level. In this manner, a tunnel to the surface of the water is provided over the water display nozzle exit, whereby the water trapped in that region can be entrained and ejected by the initial operation of the water display, allowing subsequent operation as if the exit end of the nozzle were above water level. [When rotated to a second position, the nozzle shield, as well as the nozzle, are both disposed below the surface of the water so as to not be visible.] In another embodiment, a weighted inflatable member is attached to the nozzle adjacent the exit thereof which, when inflated, will float to the surface of the water to provide a shield functioning as here before described and which, when deflated, will sink below the surface of the water out of sight. Various features of the shields are disclosed.

DETAILED DESCRIPTION OF THE INVENTION

Figure 1:
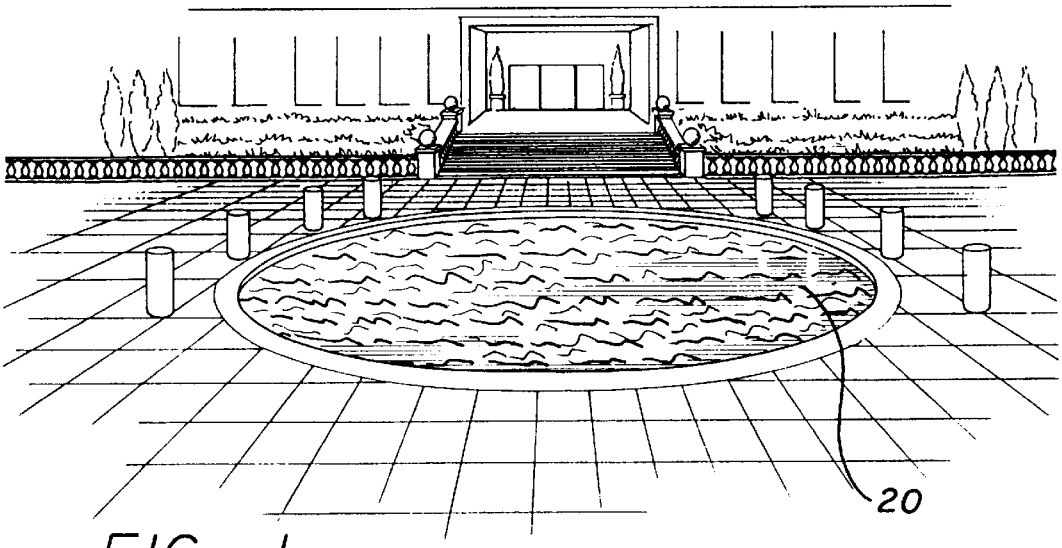
FIG. 1 is a view of a representative water display with the water display turned off and having the present invention installed and in a non operative position.
Figure 2:
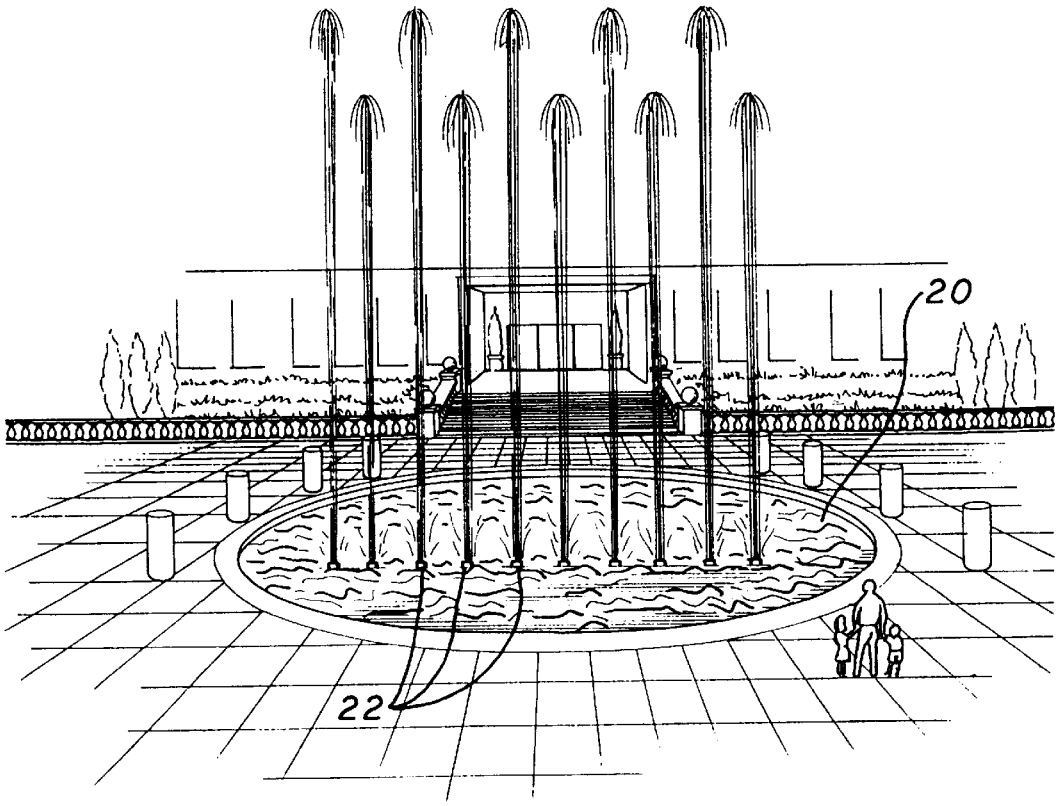
FIG. 2 is a view of the representative water display of FIG. 1 with the water display turned on and having the present invention in an operative position.

Now referring to FIGS. 1 and 2, an exemplary application for the present invention may be seen. FIG. 1 is exemplary of an installation including a pool of water 20, which when viewed at an angle such as by a person located at the periphery of the body of water, appears as having an unobstructed water surface. However, positioned below the surface of the water may be one or more water display nozzles and nozzle shields of the present invention. While the nozzles and nozzle shields are not far below the surface of the water, the same generally will not be viewable because of the inability to see through the surface of the water unless viewing the same from an angle approaching the vertical. When the water displays are in operation, however, as shown in FIG. 2, the nozzle shield barrels 22 of the present invention are first moved to a functional position wherein the same extend from adjacent the exit end of each nozzle to a position above the surface of the water, so that the first water expelled from the exit of the nozzle will entrain and remove the water from the pool entrapped within the nozzle shield barrels so that thereafter, the nozzles will operate in air as if the nozzle itself extends to above the level of the surface of the pool of water. The specific form of water display nozzle used is not important to the present invention, as the same is useful for air powered nozzles, water powered nozzles having a constant or variable operating pressure, for combinations of the foregoing, and for aerated and other types of nozzles, as desired.

Figure 3:
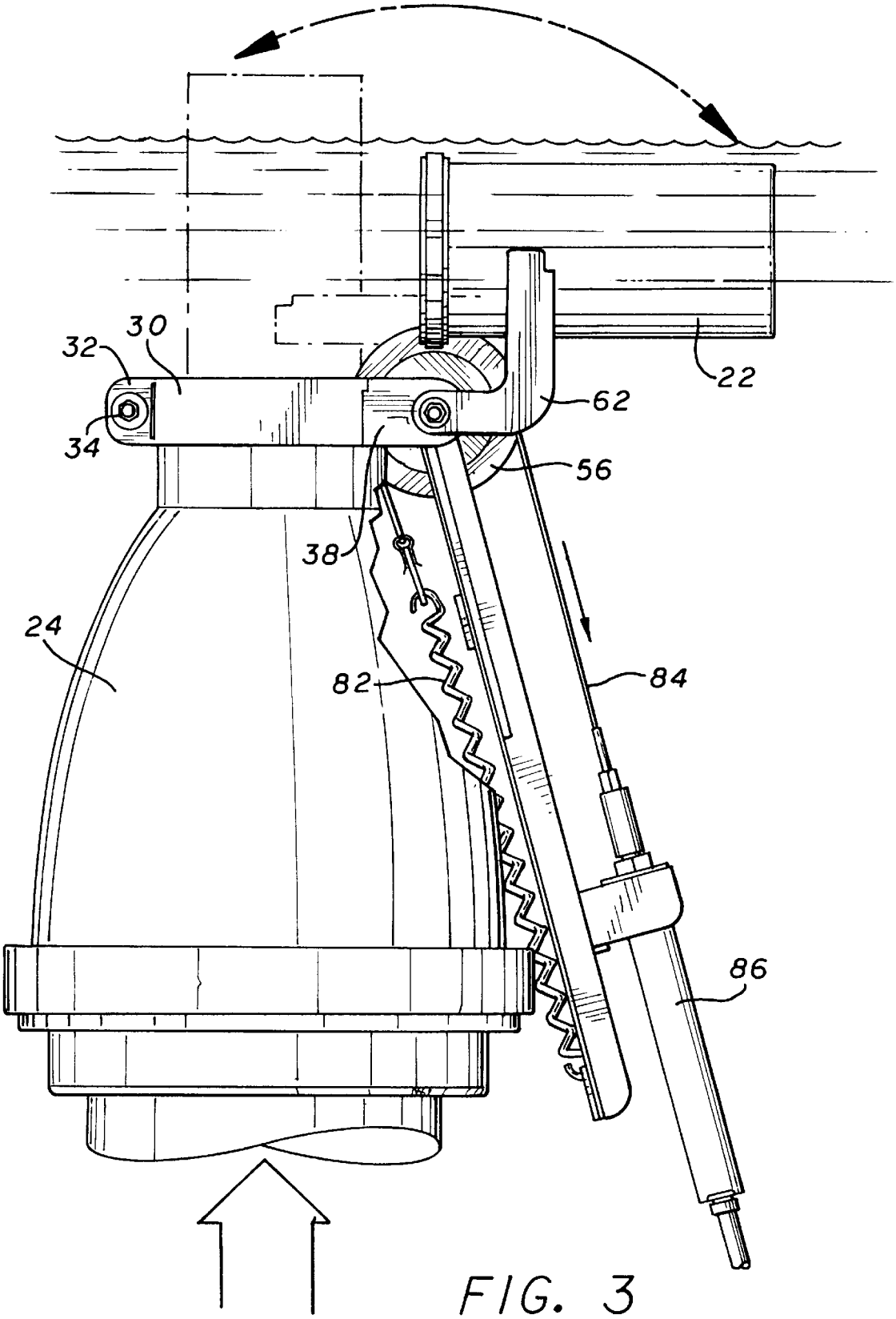
FIG. 3 is a first side view of one embodiment with the nozzle shield barrel illustrated in the inoperative position.
Figure 4:
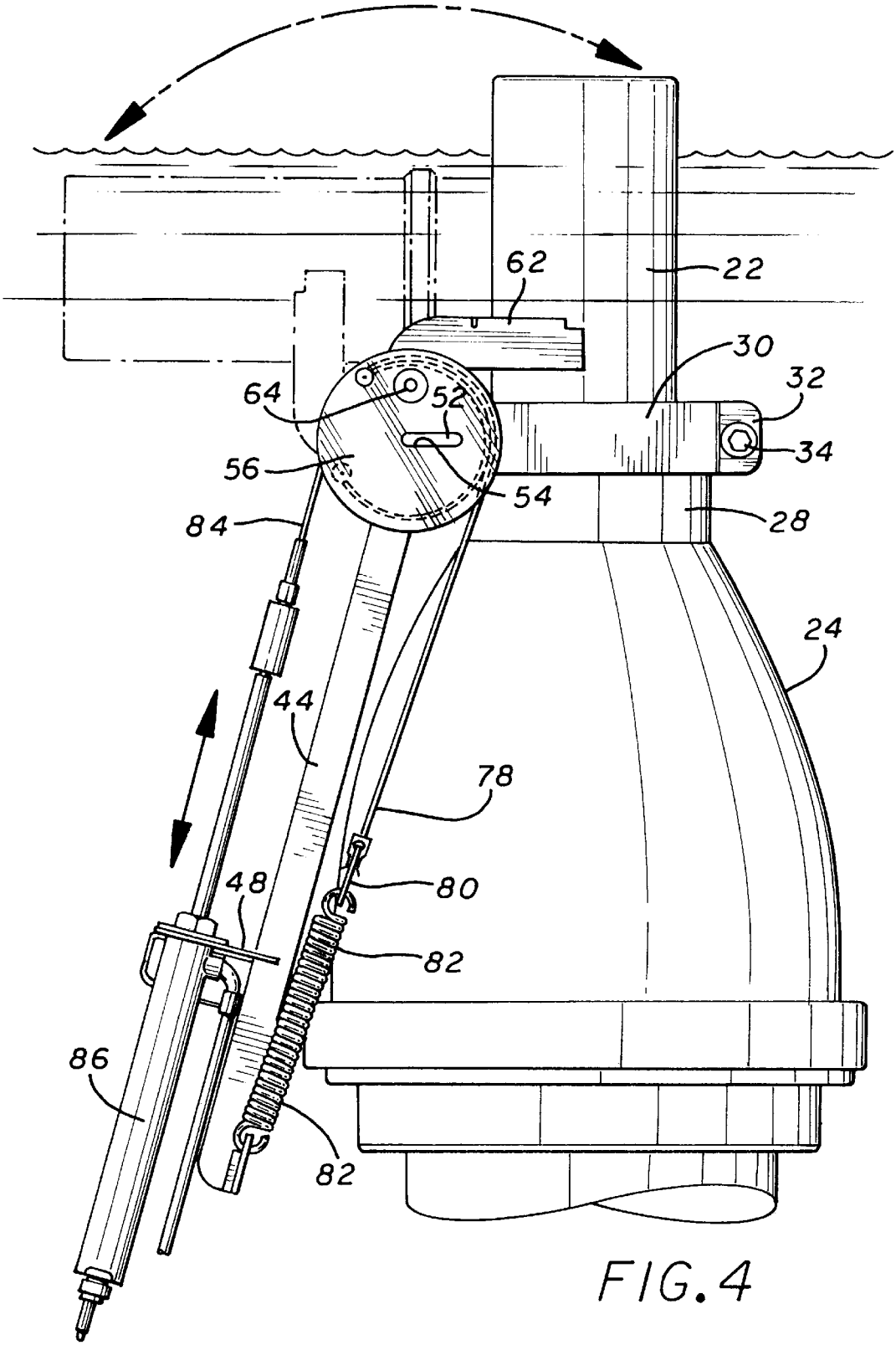
FIG. 4 is a side view opposite the side view of FIG. 3 with the nozzle shield barrel illustrated in an operative position
Figure 5:
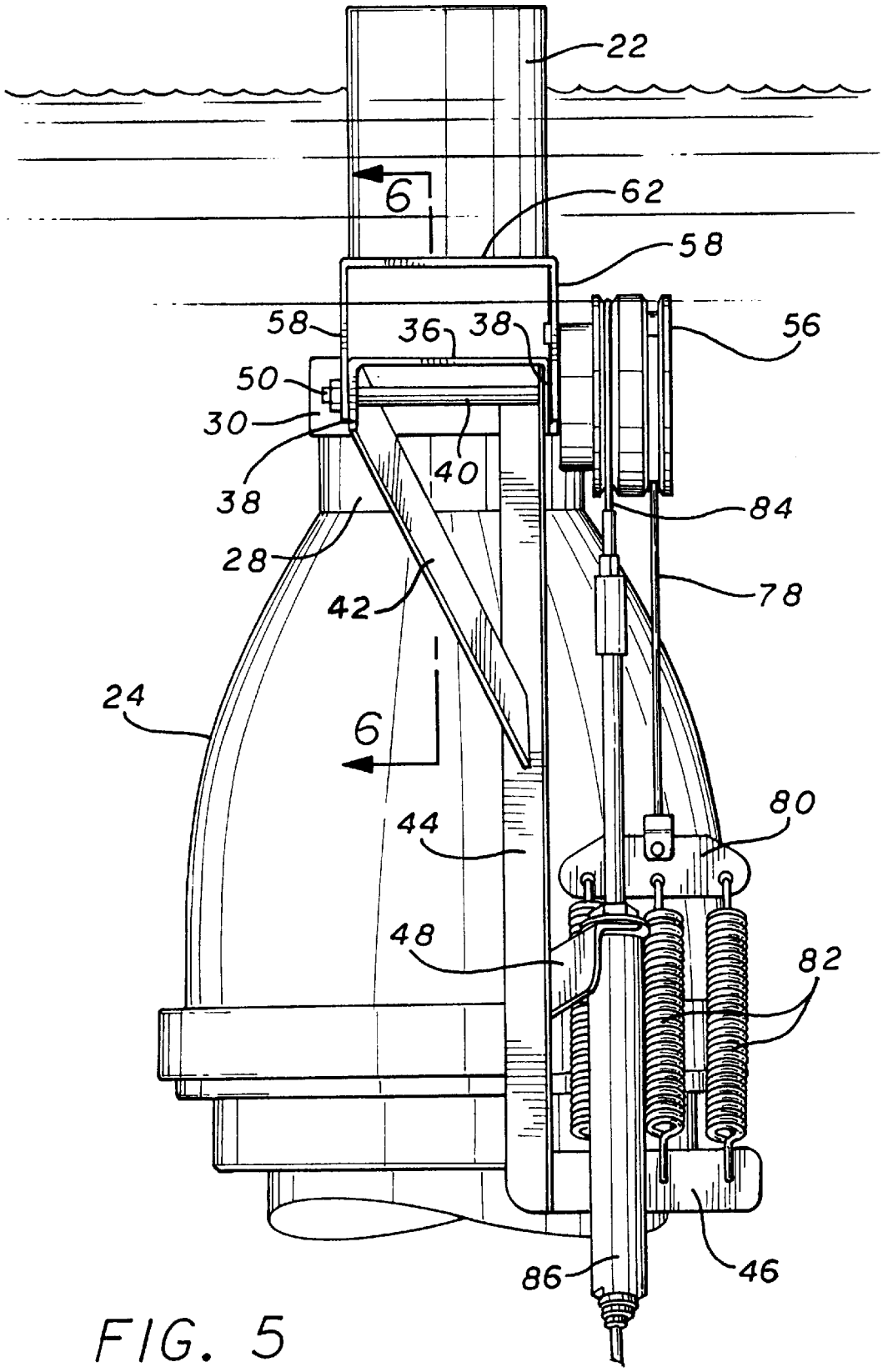
FIG. 5 is a view taken 90° from the views of FIGS. 3 and 4.

Now referring to FIGS. 3, 4 and 5, a first side view of one embodiment with the nozzle shield barrel in the inoperative position, an opposite side view with the nozzle shield barrel in an operative position, and a view taken 90° from the first and second views, respectively, may be seen. In these Figures, a representative water display nozzle 24 may be seen, though it is to be understood that nozzle 24 as shown is representative only, because of the relatively wide variation in nozzle type and design with which the present invention may be used. Adjacent the nozzle exit 26 (see also FIG. 6, which is a cross-section taken along line 6—6 of FIG. 5) is a short tubular section 28, in the preferred embodiment welded adjacent the exit 26 of the nozzle 24. [The tubular section 28 provides the support for the structure and mechanism supporting and operating the nozzle shield barrel 22,] in the embodiment illustrated itself being a simple tubular section. In particular, a sheet metal ring 30 forms a clamp, with ends 32 being forced toward each other by nut and bolt 34 to cause the sheet metal ring 30 to tightly clamp onto the tubular section 28 welded to the nozzle 24. Welded to the sheet metal ring 30 is a sheet metal bracket 36 (see particularly FIG. 5), having vertical spaced apart tabs 38, to which are welded members 42 and 44, to which in turn is welded a fixed spring mount 46 and an actuator support 48. Also rigidly fastened to the tabs 38 is tubular member 40 forming a pivot bushing for pivot rod 50.

Figure 7:
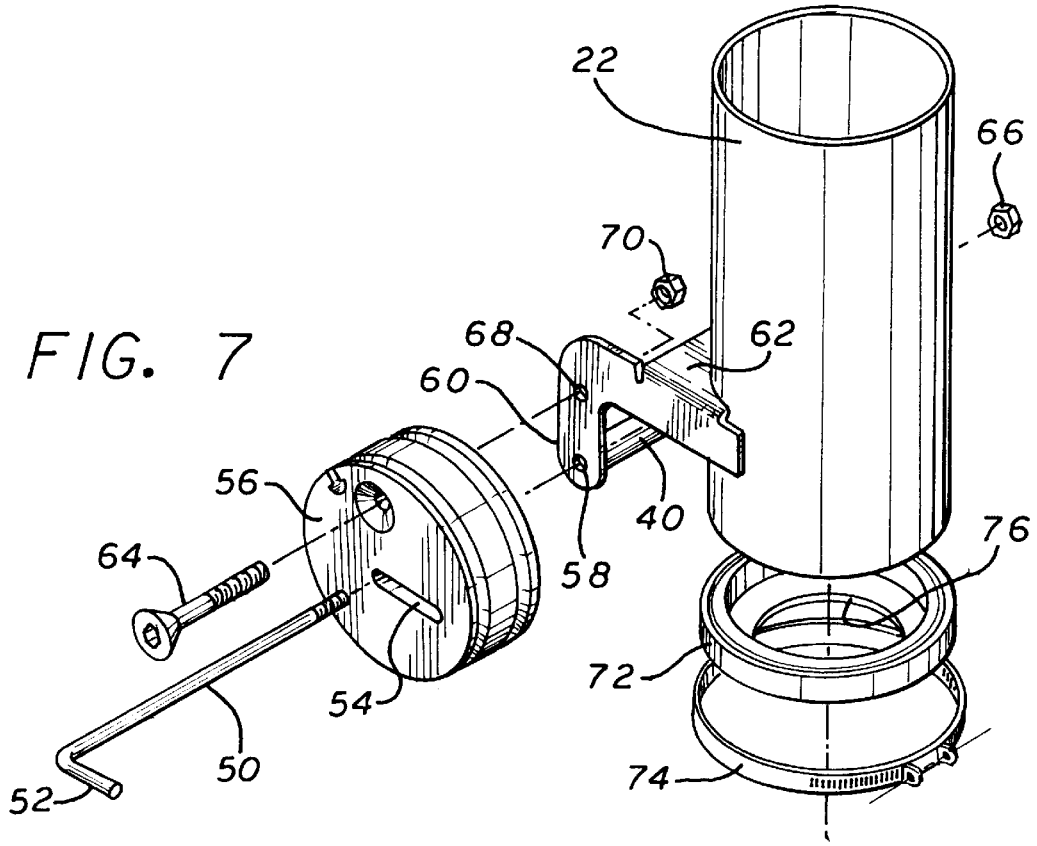
FIG. 7 is a exploded view of the shield assembly.
Figure 9:
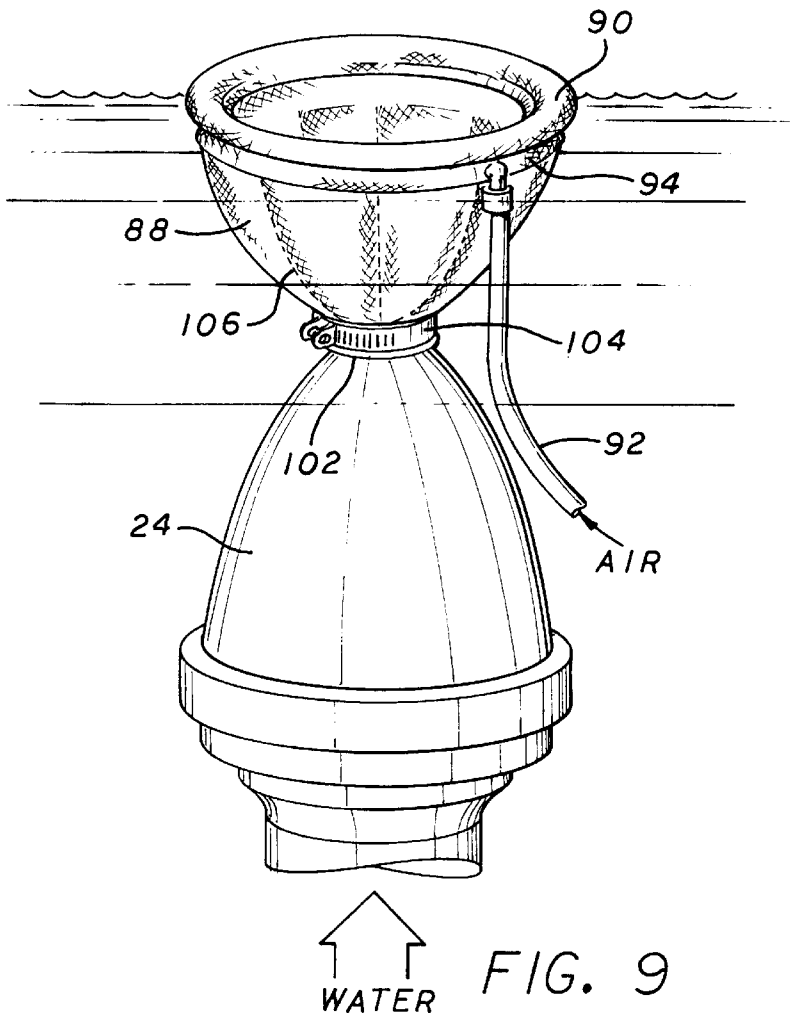
FIG. 9 is a view of the alternate embodiment of nozzle shield of FIG. 8 in an operative condition.

The pivot rod 50 may be seen in the exploded perspective view of the relevant portion of the assembly shown in FIG. 7. The pivot rod, as shown in FIG. 7, has one end 52 bent into an L-shape which fits within slot 54 in pulley member 56, with the pivot rod 50 extending through a central hole in the pulley member, in the preferred embodiment a plastic member, to extend through first holes 58 in tabs 60 of sheet metal member 62 welded to the nozzle shield 22. The pivot rod is maintained in position by lock nut 66. The pulley member 56 is rotatable about the axis of the pivot rod 50, the L-shaped extension fitting within slot 54 in the pulley member 56 assuring rotation of the pivot rod with the pulley member. The pivot bushing 40 forms a journal bearing surface for the pivot rod.

One of the tabs 60 has a second hole 68 therein, with bolt 64 passing through a cooperatively disposed hole in pulley member 56 and hole 68 in the tab to be locked in position by nut 70 so as to force the sheet metal member 62 and the nozzle shield barrel 22 to rotate in unison with the rotation of the pulley member 56 about the axis of pivot rod 50.

Figure 6:
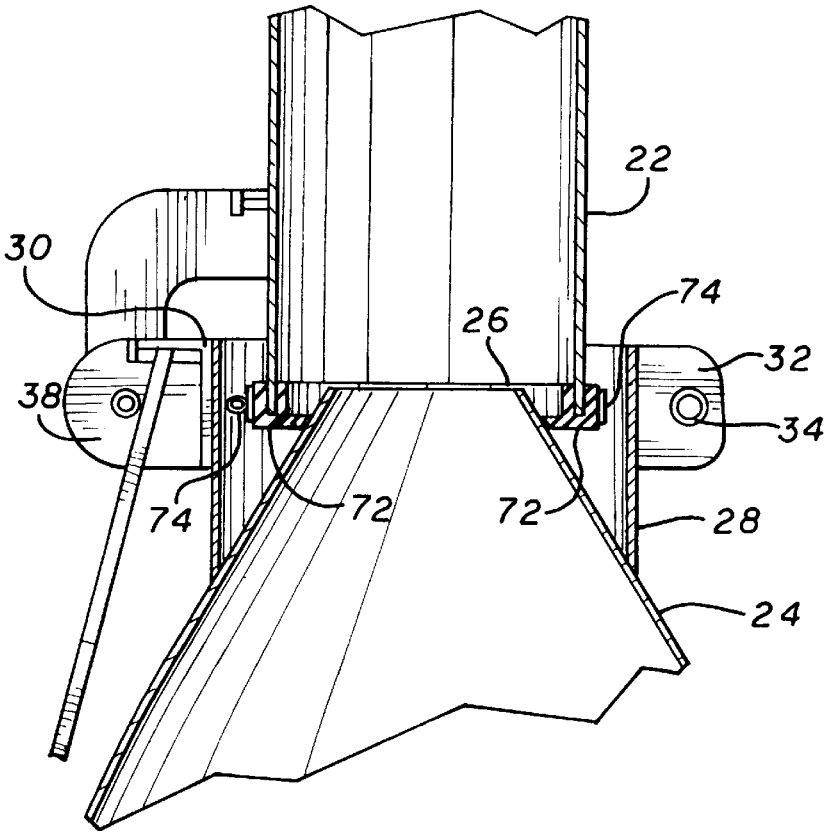
FIG. 6 is a cross sectional view taken along line 6—6 of FIG. 5 illustrating the shield seal and surrounding the structure when the shield is in the operative position.

As may be seen in FIGS. 6 and 7, at the bottom of the nozzle shield barrel 22 is a molded flexible member 72 which fits over the lower end of the nozzle shield barrel 22 and is clamped thereto by conventional hose clamp 74. The flexible member 72 has an inner periphery 76 configured in size to engage the upper region of nozzle 24 (see FIG. 6 particularly) to form a seal with the nozzle adjacent the exit end 26 thereof. This seal, of course, may not be a perfect seal, though preferably the seal would provide a maximum leak rate of only a small percentage of the water flow rate through the nozzle 24 when the same is being operated. In that regard, when the nozzle shield barrel is rotated to the operative position shown in FIG. 6 from the position shown in FIG. 3, water will be entrapped within the nozzle shield barrel 22 above nozzle 24. However, this water will be entrained with the initial flow of water through nozzle 24 to initially clear the water from the nozzle shield barrel 22, after which the nozzle 24, though physically positioned below the water level, will operate as if the same was in fact extending above the water level in the body of water in which it is disposed.

The seal formed by the flexible member 72 with the nozzle 24 illustrated in FIG. 6 is a relatively simple form of seal providing minimal flexing of the flexible member when the nozzle shield barrel moves between its inoperative and operative position or condition, though of course other forms of seals may also be used. By way of but a single example, the flexible member might comprise a flexible section which extends downward and tapered out somewhat to just fit over a short tapered portion of the nozzle 24. Such a seal would have the advantage of providing a dynamic seal in the sense that once the residual water is cleared from the nozzle shield barrel 22, the increased pressure on the outer periphery of the flexible member lying against nozzle 24 over the simple atmospheric pressure on the inner surface of the flexible member, at least adjacent the upper portion thereof, would form a sort of dynamic seal, requiring almost no flexing of the flexible member to achieve the desired sealing result. In any event, it is preferable to have the seal formed at the approximate elevation of the pivot rod axis to minimize relative horizontal motion of the seal surfaces during the final motion of the nozzle shield barrel to its operative position. In another embodiment, the flexible member 72 is clamped to the nozzle 24 and forms a seal with the lower end of the nozzle shield barrel 22 when the barrel is rotated to the operative position.

Now referring to FIGS. 3 and 4, and particularly FIG. 5, the mechanism for causing rotation of the pulley member 56 to rotate the nozzle shield barrel 22 between the positions shown in FIGS. 1 and 3, and the positions shown in FIGS. 2, 4, 5 and 6, may be seen. As shown therein, a first cable 78 is wound around pulley member 56 in a first direction, with the first end of the cable being anchored with respect to the pulley member. The opposite end of cable 78 is connected to a spring holder 80, which in turn is coupled through springs 82 to fixed spring mount 46. In the preferred embodiment, the direction of winding of the cable 78 on the pulley member 56 (see FIG. 4) is such as to cause rotation of the nozzle shield barrel 22 to its operative position by the force exerted on the cable by the springs 82. A second cable 84 wraps around the pulley member 56 in the opposite direction, with a first end of cable 84 being anchored with respect to the pulley member. The opposite end of cable 84 is connected to an actuator 86, in the preferred embodiment an air actuator, anchored to the fixed actuator support member 48. With this arrangement, actuator 86 may be used to rotate the nozzle shield barrel 22 to the position illustrated in FIGS. 1 and 3, though when the actuator is not powered, in the preferred embodiment shown herein, provided with air under pressure, such as would likely occur in the event of some failure, the nozzle shields will default to their operative conditions, allowing the water display to still function as intended.

Now referring to FIGS. 8 through 11, an alternate embodiment of the present invention may be seen. This embodiment of nozzle shield comprises an inflatable shield which, when deflated, is purposely weighted so as to sink well below the surface of the body of water in which the shield is being used and which, when inflated, will rise to a level above the surface of the body of water to function as herein before described with respect to the previously described embodiment.

Figure 8:
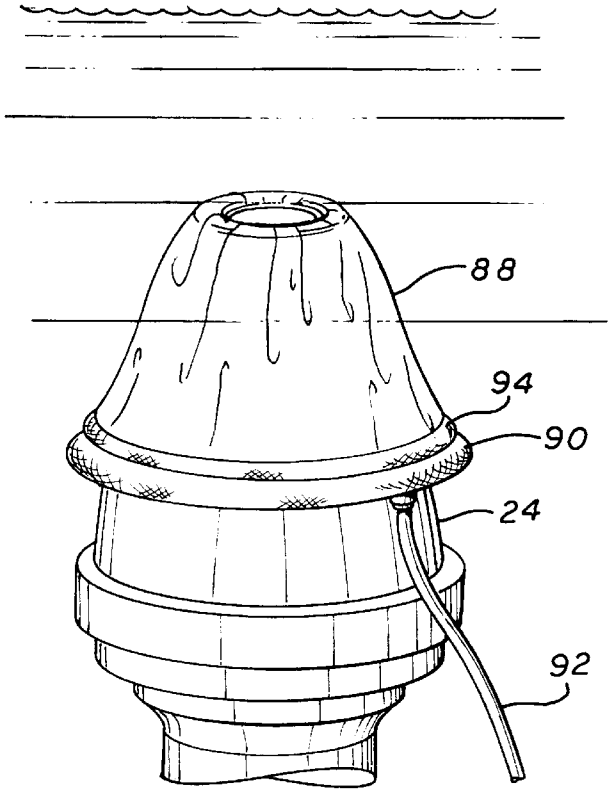
FIG. 8 is a view of an alternate embodiment of nozzle shield in a non operative condition.

The inflatable shield 88 is a two layer fabric shield sewn and sealed so as to be controllably inflatable and deflatable. Shield 88 is shown in FIG. 8 as deflated, the same sinking to well below the surface of the body of water in which it is used as a result of a weight ring sewn into the outer peripheral region 90 of the shield. The shield may be inflated, however, through air hose 92 supplying air to an inflation ring sewn into region 94 (see FIG. 9) to inflate the conical section of the shield 88 so that the same will float and hold the upper periphery of the shield above the surface of the water.

Figure 10:
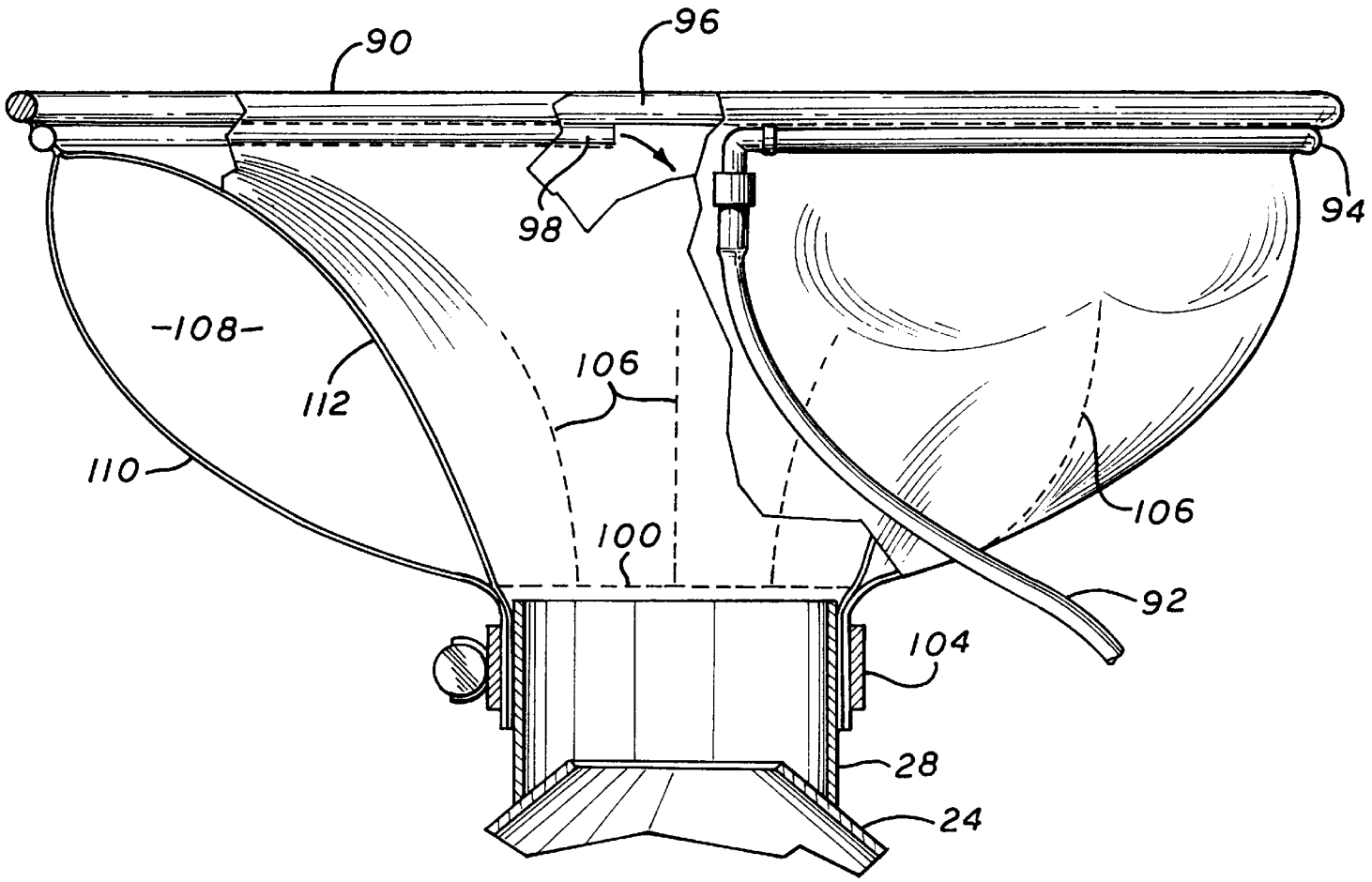
FIG. 10 is a partial cross sectional side view of the nozzle shield of FIGS. 8 and 9 when inflated to the operative condition.
Figure 11:
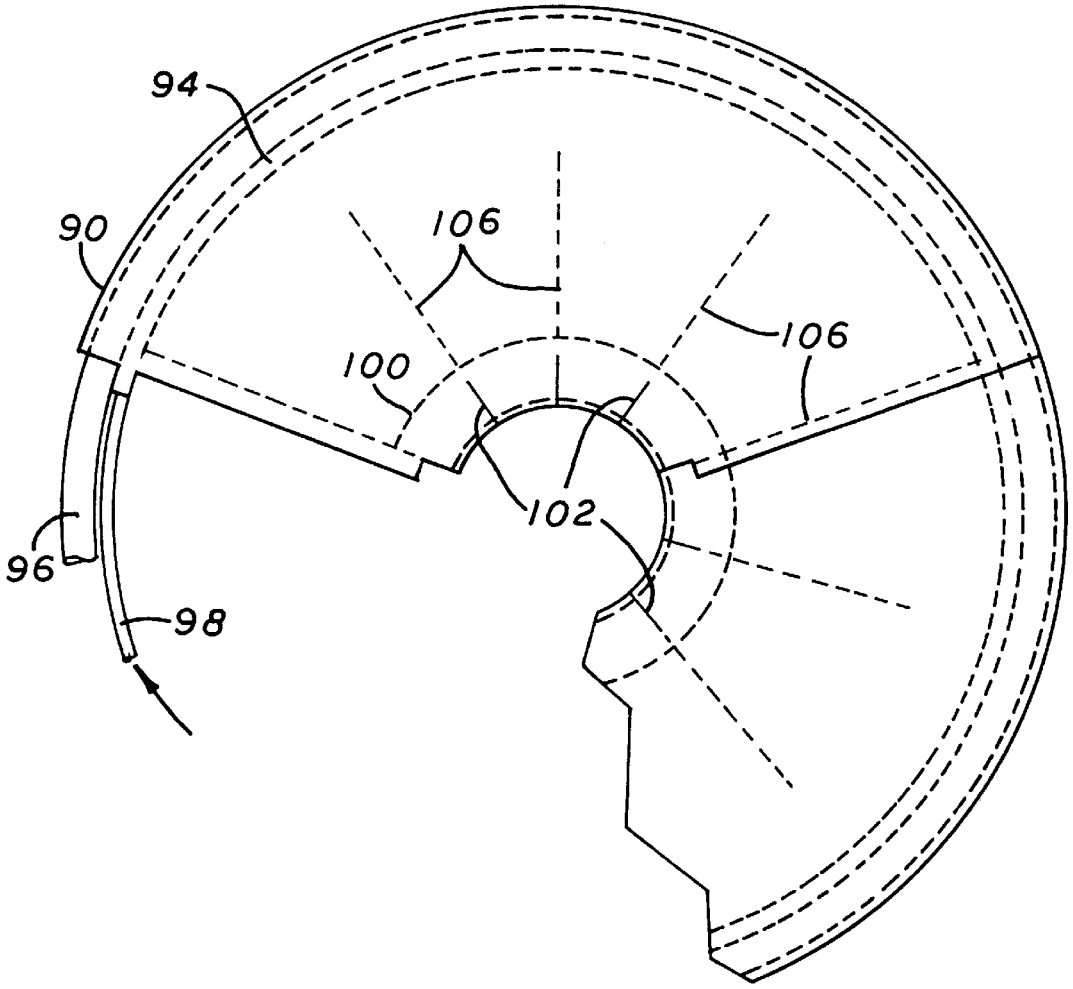
FIG. 11 is a plan view, partially cutaway, of the alternate embodiment shield assembly of FIGS. 7 through 10.

FIG. 11 illustrates a face view of a portion of the inflatable shield, showing the weight ring 96, a metal ring sewn into the peripheral region of the multiple layer fabric shield, and the inflation ring 98 sewn into region 94 of the shield. In the central region, inside the circular stitch 100, are slits 102 which allow this portion of the shield to extend vertically adjacent the tubular section 28 welded to the top of nozzle 24 as before, and to be clamped to that tubular section by ordinary hose clamp 104 (see FIGS. 9 and 10). In that regard, FIG. 10 is a side view of the inflated shield of FIG. 9, taken on an expanded scale and showing one of the inflatable pockets therein as inflated. In particular, radial stitch lines 106 through the two layers of flexible material define inflatable pockets there between, the pockets being in air communication around the periphery thereof as a result of the stitching 106 terminating short of any circular peripheral stitching in the assembly. Thus, inflatable pockets 108 are defined by the two layers 110 and 112 of the material to provide the desired floatation as described. Obviously, while this embodiment represents one embodiment of inflatable shield, other or additional inflatable areas may readily be defined in this or other embodiments to provide the effect desired. In any event, preferably the stitched areas are appropriately sealed to prevent substantial air leaks, and to prevent such leaks from blowing bubbles in the body of water in which this embodiment might be used.

In the embodiments disclosed herein, a single nozzle shield is provided for each nozzle. However, in certain instances, a single shield mechanism, whether inflatable, rotatable or otherwise, might be advantageously used in conjunction with multiple nozzles.

Thus, while certain preferred embodiments of the present invention have been disclosed and described herein, it will be understood by those skilled in the art that various changes in form and detail may be made therein without departing from the spirit and scope of the invention.

What is claimed is:

1. A nozzle shield comprising:

a conduit having first and second ends and being moveable between first and second positions, the conduit when in the first position having the first end disposed adjacent an exit end of a nozzle, the nozzle having the exit end disposed completely below a surface of a body of water, and the second end extending to a position above the surface of the body of water, the conduit when in the second position being disposed completely below the surface of the body of water; and, a seal sealing the first end of the conduit, when in the first position, and the nozzle against a substantial flow of water there between.

2. The nozzle shield of claim 1 wherein the seal also seals the first end of the conduit and the nozzle when the conduit is in the second position.

3. The nozzle shield of claim 2 wherein the shield is controllably inflatable, and when inflated is encouraged by flotation to the first position.

4. The nozzle shield of claim 3 wherein the nozzle shield is sufficiently heavy to sink to the second position when deflated.

5. The nozzle shield of claim 3 wherein the nozzle shield includes at least one weight to cause the nozzle shield to sink to the second position when deflated.

6. The nozzle shield of claim 2 wherein the seal comprises a substantially permanent attachment of the nozzle shield to the nozzle adjacent the exit end of the nozzle.

7. The nozzle shield of claim 6 wherein the nozzle shield has a substantially conical shape.

8. The nozzle shield of claim 1 wherein the conduit is a rigid conduit.

9. The nozzle shield of claim 8 wherein the conduit is rotatable between the first and second positions.

10. The nozzle shield of claim 9 wherein the conduit is controllably rotatable about a substantially horizontal axis.

11. The nozzle shield of claim 9 wherein the conduit is continuously encouraged to the first position, and is controllably forcibly rotatable to the second position.

12. The nozzle shield of claim 9 wherein the conduit is continuously encouraged to the first position by at least one spring, and is controllably forcibly rotatable to the second position by an actuator.

13. The nozzle shield of claim 12 wherein the actuator is an air powered actuator.

14. The nozzle shield of claim 8 wherein the conduit is a cylindrical conduit.

15. The nozzle shield of claim 1 wherein the seal is a flexible seal attached to the first end of the conduit.

16. A nozzle shield comprising:

a conduit having first and second ends and being moveable between first and second positions, the conduit when in the first position having the first end disposed adjacent an exit end of a nozzle, the nozzle having the exit end disposed completely below a surface of a body of water, and the second end extending to a position above the surface of the body of water, the conduit when in the second position being disposed completely below the surface of the body of water, the conduit forming a passageway from the exit of the nozzle to a position above the surface of the body of water of sufficient size to not substantially effect the operation of the nozzle; and, a seal sealing the first end of the conduit, when in the first position, and the nozzle against a substantial flow of water there between.

17. The nozzle shield of claim 16 wherein the seal also seals the first end of the conduit and the nozzle when the conduit is in the second position.

18. The nozzle shield of claim 17 wherein the shield is controllably inflatable, and when inflated is encouraged by flotation to the first position.

19. The nozzle shield of claim 18 wherein the nozzle shield is sufficiently heavy to sink to the second position when deflated.

20. The nozzle shield of claim 18 wherein the nozzle shield includes at least one weight to cause the nozzle shield to sink to the second position when deflated.

21. The nozzle shield of claim 17 wherein the seal comprises a substantially permanent attachment of the nozzle shield to the nozzle adjacent the exit end of the nozzle.

22. The nozzle shield of claim 21 wherein the nozzle shield has a substantially conical shape.

23. The nozzle shield of claim 16 wherein the conduit is a rigid conduit.

24. The nozzle shield of claim 23 wherein the conduit is rotatable between the first and second positions.

25. The nozzle shield of claim 24 wherein the conduit is controllably rotatable about a substantially horizontal axis.

26. The nozzle shield of claim 24 wherein the conduit is continuously encouraged to the first position, and is controllably forcibly rotatable to the second position.

27. The nozzle shield of claim 24 wherein the conduit is continuously encouraged to the first position by at least one spring, and is controllably forcibly rotatable to the second position by an actuator.

28. The nozzle shield of claim 27 wherein the actuator is an air powered actuator.

29. The nozzle shield of claim 23 wherein the conduit is a cylindrical conduit.

30. The nozzle shield of claim 16 wherein the seal is a flexible seal attached to the first end of the conduit.

* * * * *